US005662155A

United States Patent [19]

Landua

[11] Patent Number: 5,662,155

[45] Date of Patent: Sep. 2, 1997

[54] DEVICE AND METHOD FOR PLACING A POURING BASIN ON A SAND MOLD

[75] Inventor: Werner Landua, Mannheim, Germany

[73] Assignee: Adolf Hottinger Maschinenbau GmbH, Mannheim, Germany

[21] Appl. No.: 651,003

[22] Filed: May 21, 1996

Related U.S. Application Data

[63] Continuation of Ser. No. 379,560, filed as PCT/DE93/00590 Jul. 6, 1993 published as WO94/03293 Feb. 17, 1994, abandoned.

[30] Foreign Application Priority Data

Aug. 3, 1992 [DE] Germany ..... 42 25 577.5

[51] Int. Cl.[6] ..... B22C 9/02; B22C 9/08; B22C 15/28

[52] U.S. Cl. ..... 164/27; 164/38; 164/137; 164/195; 164/200

[58] Field of Search ..... 164/38, 137, 339, 164/200, 201, 202, 27, 195; 382/379.5

[56] References Cited

U.S. PATENT DOCUMENTS 2,198,498 4/1940 Hagemeyer .
4,126,176 11/1978 Muller et al. ..... 164/201 X
4,711,292 12/1987 Rommel et al. ..... 164/200

FOREIGN PATENT DOCUMENTS 56-135 1/1981 Japan ..... 164/195
60-223638 11/1985 Japan .
1-273648 11/1989 Japan .

*Primary Examiner*—J. Reed Batten, Jr.
*Attorney, Agent, or Firm*—Bell, Seltzer, Park & Gibson, P.A.

[57] ABSTRACT

A pouring basin (1) or funnel made of a mold material, such as sand is molded, and then positioned on a sand casting mold (2). In order to increase the usable casting time in the casting of a workpiece in the casting mold and at the same time avoid any increase in station time, the apparatus includes a mechanism designed to mold and consolidate the pouring basin (1) and then to place the consolidated pouring basin (1) directly on the casting mold (2) in alignment with the pouring hole thereof.

20 Claims, 4 Drawing Sheets

DEVICE AND METHOD FOR PLACING A POURING BASIN ON A SAND MOLD

This application is a continuation of application Ser. No. 08/379,560, filed as PCT/DE93/00590 Jul. 6, 1993 published as WO94/03293 Feb. 17, 1994 and now abandoned.

BACKGROUND OF THE INVENTION

The invention relates to a device and method for placing a pouring basin or funnel consisting of molding material, in particular molding sand, on a casting mold of molding material such as sand.

Basically, the present invention relates to the field of foundry practice. For casting molded bodies, foundry cores or molds are generally made in separate parts, combined and joined to one another to form a casting or sand mold. Thereafter, these sand molds are filled with a molten metal for making, for example, a metallic workpiece, in the series production the sand molds to be filled with molten metal advancing one after the other along the production line.

The time required for filling or pouring the liquid metal into a sand mold determines ultimately the cycle time, inasmuch as it is necessary to always make sure that each sand mold is filled with an adequate quantity of metal through a relatively small pouring hole. Only upon completion of the filling operation, can the filled sand mold be advanced to the next station for further processing.

However, the above-described method of filling a sand mold with molten metal is problematic insofar as the time-consuming filling of the sand hold is to be considered always as a critical cycle time and, thus, influences considerably the total production time. Since the actual cycle times at the other processing stations are substantially shorter, the actual cycle time and, thus, the total production time of a casting are considerably lengthened by the filling of the sand mold.

Devices for making sand molds of the type in question are already known from numerous publications. By way of example only, reference may be made to DE-OS 23 04 564.

It is accordingly an object of the present invention to alleviate the above-described problematic situation with respect to the critical cycle time for filling the sand molds with molten metal. In this connection, it is intended to realize with simple means an adequate casting time at a reduced cycle time or a lengthened casting time at a constant cycle time. Furthermore, a corresponding method is described, which results in a decrease of the cycle time during the actual pouring of the material.

SUMMARY OF THE INVENTION

The above and other objects and advantages of the present invention are achieved by the provision of an apparatus which comprises a shooting vessel having an upper end and a lower end, an upper chamber communicating with the upper end of the vessel, a working frame mounted for limited upward and downward movement in the lower portion of the chamber, and at least one nozzle formed in the working frame. Means are provided for selectively displacing the working frame in the upward and downward directions, and a shooting mold is positioned below the working frame and so as to communicate with the lower end of the vessel.

A shooting and clamping head and a counterholding plate are disposed in a vertically spaced apart arrangement so as to define a shooting and pressing position therebetween. Also, the apparatus includes means mounting the shooting vessel for alternate movement between the shooting and pressing position and an ejecting position spaced therefrom and overlying a casting mold. By this construction, the shooting vessel may be moved to the shooting and pressing position where a pouring basin may be molded in the shooting mold and then consolidated by displacing the working frame downwardly so as to press the basin against the counterholding plate. Also, the vessel and the molded and consolidated basin may then be moved to the ejecting position where the basin may be ejected onto the casting mold by downward movement of said working frame.

In accordance with the invention it has been recognized, first, that the operation of pouring the molten metal into the sand mold takes always an enormous amount of time, due to the fact that the pouring hole has quite generally only a small diameter. Until now, the sand mold has been held at the pouring station for this period of time, thereby predetermining the cycle time as a whole. In the manner of the present invention, the period of time necessary for pouring is decoupled from the actual pouring station, in that a pouring basin in the shape of a funnel is placed around the pouring hole of the sand mold. This pouring basin or funnel has a very large opening and forms quasi a basin for the melt, so as to permit the molten metal to be poured very rapidly into the pouring basin surrounding the actual pouring hole of the sand mold. Thence the liquid metal enters through the narrower pouring hole into the interior of the sand mold.

After having adequately filled the pouring basin with molten metal, however, the sand mold can already be advanced to the next working station, so as to permit the liquid metal to flow fully into the interior of the sand mold during its transportation to the next working station. Consequently, the time necessary for filling the sand mold is no longer critical with respect to the cycle time. Accordingly, the filling time no longer determines the normally very long cycle time per working station.

In a further advantageous manner of the present invention, it has been recognized that at least the pouring basin or funnel serving indirectly for the reduction of the cycle time, can suitably be made of the same material as the sand mold itself. Accordingly, in the same manner as the sand mold, it is possible to make or shoot, consolidate, and place the pouring basin after its manufacture directly on the sand mold, so that there exists between the pouring basin and the sand mold at least a mechanical engagement and, thus, a high coefficient of friction, thereby effectively preventing the pouring basin from sliding when being filled with the molten metal.

In an advantageous manner, the pouring basin is in the shape of a funnel with a wall having an approximately annular shape or being closed by means of straight edges via corners. The outer geometry of the pouring basin—be it circular or, for example, square—is only of secondary importance. In a particular advantageous manner, the wall of the pouring basin widens cross sectionally toward its end associated with the sand mold such that the inside cross section of the pouring basin narrows and, thus, has at least in the its inner region the shape of a funnel. This allows to ensure in a particularly suitable manner that the metal poured into the sand mold and into the pouring basin enters indeed through the pouring hole of the sand mold into the interior thereof, and fills therein the interior space entirely. Also, the liquid metal filled into the pouring basin pushes the pouring basin, as a result of its inclined inside surfaces, against the sand mold, thereby increasing substantially the operational dependability of the pouring basin. Added to this is the further advantage that the pouring basin has the effect of a kind of extended riser or the like.

With respect to the configuration of the mechanism for shooting, consolidating and directly placing the pouring basin, it will be especially advantageous, when same is provided with a vessel comprising at least one nozzle and a mold subjacent thereto. The number of the nozzles necessary for making or shooting the pouring basin is dependent on the form of the shooting nozzles, which will be described in more detail further below.

The shooting mold predetermines the shape of the pouring basin to be produced, it being open toward the free end of the vessel, i.e., its lower end. Furthermore, a shooting and clamping head as well as a counterholding mechanism are provided, so as to permit the vessel to be clamped and essentially sealed between the shooting and clamping head and the counterholding mechanism in a shooting and pressing position. The counterholding mechanism forms the lower boundary of the shooting mold, so as to permit in its operating position the molding material to flow or be shot only through the shooting nozzles.

Both with respect to a suitable compression and an effortless ejection of the pouring basin it will be especially advantageous, when the shooting nozzle or nozzles is or are formed in a working frame serving a shooting, pressing and ejecting frame. In this arrangement, the shooting nozzles may be formed as hole-type or slot-type nozzles, it being necessary to provide always several shooting nozzles, when same are of the hole-type configuration, so as to obtain a pouring basin that is molded more or less homogeneously.

The working frame comprising the shooting nozzle or nozzles is sealably arranged for displacement in axial direction on the inside wall of the vessel, preferably in the region of the end facing the counterholding mechanism. Consequently, after having been shot through the working frame, it is possible to additionally mold and subsequently size the pouring basin, and to eject same from the mold, or force it onto the sand mold after being raised from the counterholding mechanism.

For purposes of having the working frame fulfill its assigned tasks, same is operatively connected in a further advantageous manner with an entrainment plate extending in the center approximately crosswise to the direction of movement of the working frame. Thus, the entrainment plate permits the working frame to be axially displaced, on the one hand for molding, on the other hand for ejecting the pouring basin as well as for forcing same onto the sand mold. Furthermore, the working frame is arranged for sealably sliding between the inside wall of the shooting vessel and the outside wall of an inside block arranged approximately in the center of the vessel.

Formed within the inside block is at least one cylinder serving as a compression and ejection cylinder, which can be biased hydraulically or pneumatically on both sides. The entrainment plate extends in the sense of a piston through the cylinder, and the working frame is dimensioned and arranged for sliding movement such that it or its seals directed toward the outside wall of the inside block always seal the passage of the entrainment plate through the inside block. In other words, depending on the biasing of the cylinder in question, it is possible to move the entrainment plate in the sense of a piston upward or downward, thereby permitting to bias again the working frame for pressing or compacting the pouring basin or for ejecting or forcing same onto the sand mold.

With respect to the configuration of the shooting and clamping head it is especially advantageous, when same is provided with a shooting air connection and an air filter, the latter serving in particular to filter the air possibly returning after the shooting. The air filter prevents effectively a return flow of molding sand into the compressed air generating units of the device.

In particular with respect to a smooth process sequence, the shooting and clamping head is vertically movable by means of an upper clamping cylinder, so that it can be positioned automatically on the vessel for shooting the pouring basin.

The counterholding mechanism is provided with a lower pressure plate vertically movable by means of the lower clamping cylinder, this pressure plate closing the mold downwardly during the shooting of the pouring basin. After the actual shooting and pressing, or subsequent sizing of the pouring basin, the pressure plate is again moved downward by means of the clamping cylinder, and the shooting and clamping head is raised from the shooting vessel, so that same can swing out of the region between the shooting and clamping head and the counterholding mechanism, i.e., out of its shooting and pressing position. The friction between the shot and pressed pouring basin and the inside wall of the shooting mold suffices to prevent the pouring basin from sliding downward or falling out of the shooting mold.

With respect to an effective reduction of the cycle time, it is of very special advantage, when at least one further shooting vessel is provided. In an especially advantageous manner, two shooting vessels are provided to this end. The shooting vessels are alternately movable by means of a rotating mechanism from the shooting and pressing position between the shooting and clamping head and the counterholding mechanism to an ejecting position. At the ejecting portion, the shooting vessel is located immediately above the sand mold, and a sand bunker may be located above the shooting vessel for refilling the shooting vessel if need be.

In a further advantageous manner, the rotating mechanism in question is provided with a swing arm holding the shooting vessels, which is jointed for vertical and rotational movement, preferably about in the center between the shooting vessels, via a column and a cylinder-piston arrangement, to a machine frame.

Basically, the vertical movability of the shooting vessels serves to position the pouring basin in an optimal manner on the sand mold. While the compacted pouring basin is pushed out of the mold by the movement of the working frame and forced onto the sand mold, the entire shooting vessel is raised from the sand mold, so as to prevent the pouring basin from being crushed or destroyed. Thus, the movements of the working frame and the shooting vessel compensate to a certain extent, so as to prevent an excessive pressure on the pouring basin, or even on the sand mold.

As regards an optimal arrangement of the two shooting vessels, it will be of particular advantage, when the shooting and pressing position and the ejecting and, possibly, the refilling position are diametrically opposed to one another. Consequently, it will accordingly be of advantage, when the rotating mechanism is rotatable by about 180°, so that the then likewise diametrically opposite shooting vessels can be moved to the two working positions by rotating the rotating mechanism.

Likewise, the rotating mechanism as a whole could be variable in its horizontal position, thereby making again the shooting vessels vertically adjustable. The swing arm of the rotating mechanism could be articulated to the shooting vessel, preferably for rotational or pivotal movement, via a cylinder-piston arrangement, so that the shooting vessel is vertically adjustable, in particular when depositing or applying the pouring basin. Consequently, it would be possible to adjust the shooting vessels in their height both via the cylinder-piston arrangement between the swing arm or column and the machine frame, and via the cylinder-piston arrangement between the swing arm and the shooting vessel.

Furthermore, an upper transverse beam of the machine frame could support an automatic displacement shaft of the cylinder-piston arrangement or of the column supporting the swing arm. This automatic displacement shaft would allow to adapt the ejecting position of the shooting vessel exactly to the pouring hole of any desired sand molds, or to adjust it to their position. Consequently, it would be possible to provide different sand molds with pouring basins, without performing a circumstantial retrofitting of the device. The automatic displacement shaft would in any event have to be furnished with parameters relating to the position of the sand mold or its geometry.

In accordance with the method aspects of the invention, a pouring basin or funnel consisting of a molding material, in particular molding sand, is positioned on a mold of molding material or sand with the use of an apparatus as described above. The method of the present invention comprises the steps of first shooting the pouring basin; then consolidating the pouring basin in the molds; and subsequently placing the shot and consolidated pouring basin directly on the sand mold.

In a particularly advantageous manner, the consolidation of the pouring basin occurs mechanically, namely, by a one-axial pressing or subsequent sizing. Likewise however, it would also be possible to add a binding substance, as is normally done in the production of foundry cores.

With respect to the method of the present invention, it will further be of advantage, when the shooting and consolidation occur in a shooting and pressing position, and the ejection and positioning on the sand mold in an ejecting position. In the ejecting position, the pouring basin is ejected, and simultaneously pushed by the ejection force onto the sand mold, so that at least a mechanical gear-tooth-type engagement occurs. When ejecting the pouring basin, the shooting vessel is raised from the sand mold together with the shooting mold, so as to effectively prevent a destruction, on the one hand, of the pouring basin, on the other hand, of the sand mold that is to receive the pouring basin. Finally, in the ejecting position, it is also possible to refill the shooting vessel with molding sand, preferably with core sand.

As regards a fully automatic production, in particular both with respect to furnishing different sand molds with pouring basins in a fully automated operation, and with respect to subsequently pouring molten metals, it will be especially advantageous, when it is possible to detect the pouring holes provided in the sand molds, and to exactly position the shooting vessel in its ejecting position in accordance with the position of the pouring holes, so that also the most different sand molds can be provided, one after the other, with pouring basins, without having to retrofit the device. Likewise, this step permits to substantially reduce the total processing or production time. The detection of the pouring holes may occur via control parameters when the sand molds are pressed or advanced based on the dimensions of the sand molds, as well as on the individual position of the pouring hole in the sand mold.

Finally, with respect to a fully automatic production at the shortest cycle time, it will be especially advantageous, when during the shooting and the subsequent pressing of the shooting vessel being in the shooting and pressing position, the second shooting vessel being in the ejecting and refilling position ejects the pouring basin approximately at the same time, forces same onto the sand mold, and is refilled with molding material, if necessary. The cycle time which is predetermined on the one hand in the shooting and pressing position, on the other hand in the ejecting and refilling position, amounts to less than ten seconds.

BRIEF DESCRIPTION OF THE DRAWINGS

Some of the objects and advantages of the present invention having been stated, others will appear as the description proceeds and when considered in conjunction with the accompanying drawings, in which.

DETAILED DESCRIPTION OF THE PREFERRED EMBODIMENT

Shown commonly in the figures is a device for positioning a pouring basin 1 consisting of molding sand on a sand mold 2. In accordance with the invention, the device comprises a mechanism for shooting, consolidating, and positioning the shot and consolidated pouring basin directly on sand mold 2.

The pouring basin 1 selected in this embodiment has an approximately rectangular shape, the straight edges of the pouring basin being closed via corners to form a peripheral wall. The wall of pouring basin 1 widens cross sectionally toward its end associated to sand mold 2, so that pouring basin 1 narrows in its free inside cross section.

Figure 1:
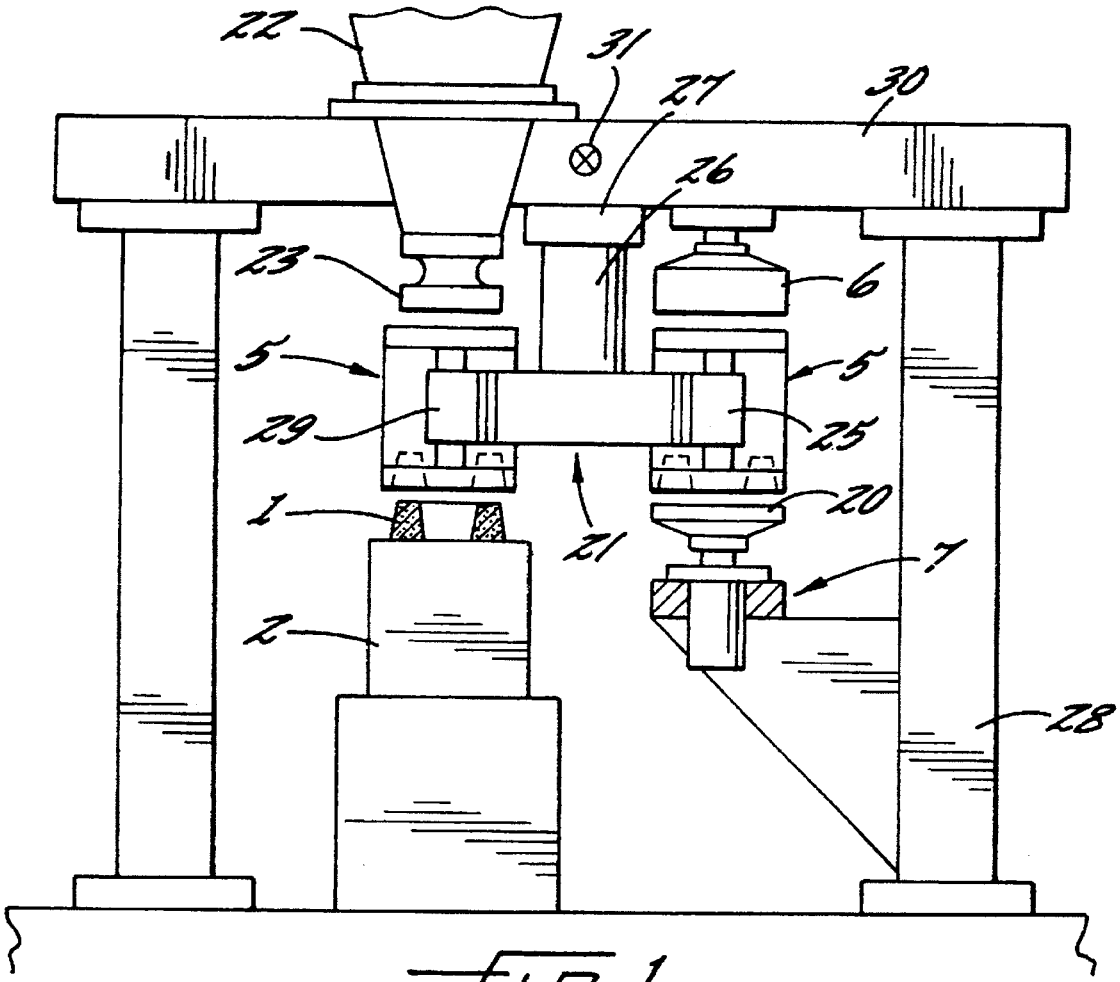
FIG. 1 is a schematic side view of an embodiment of the device in accordance with the invention for positioning a pouring basin consisting of molding sand on a sand mold, the embodiment having a total of two shooting vessels.
Figure 2:
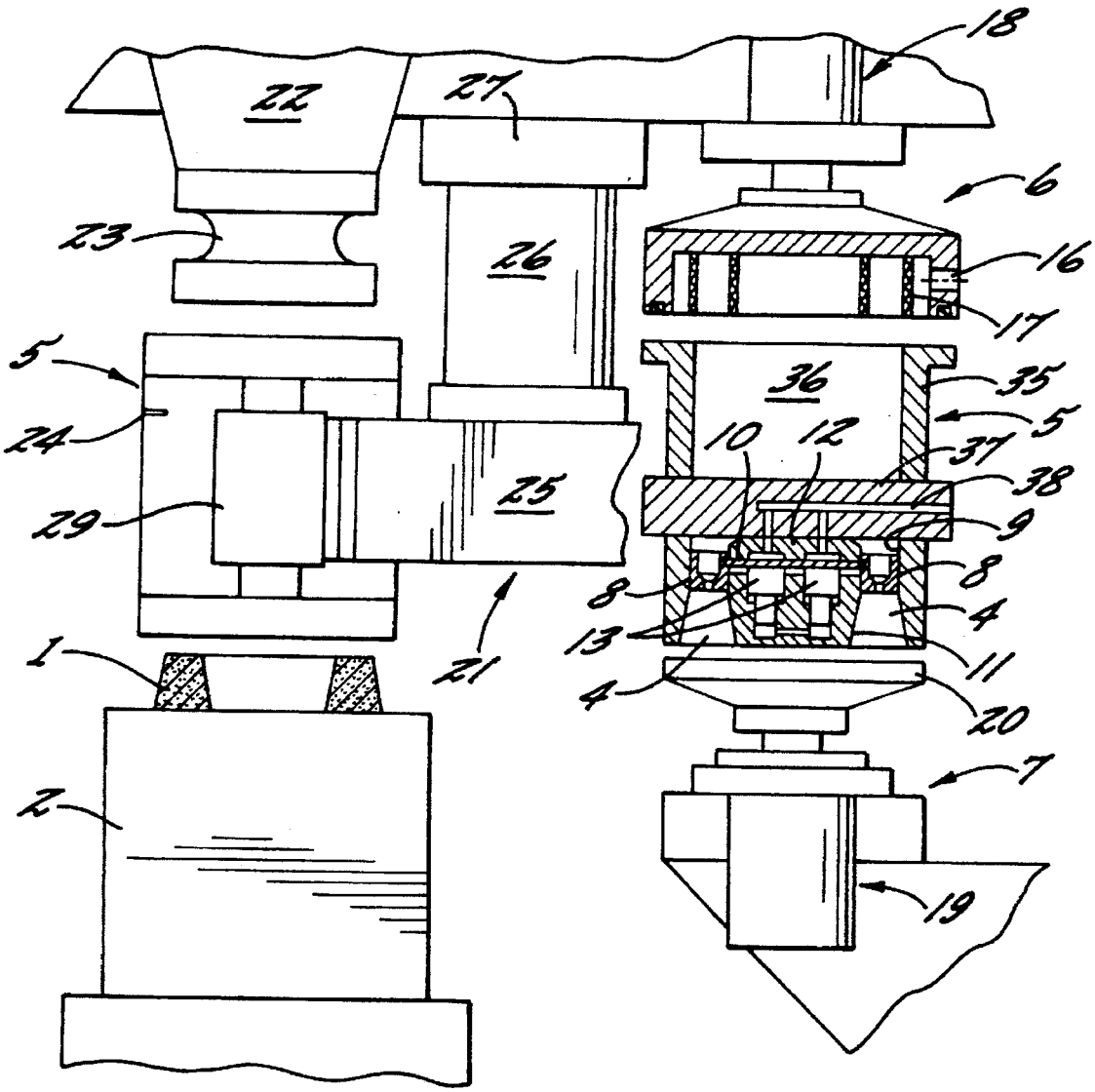
FIG. 2 is a schematic, enlarged view, partially cut, of the subject matter of FIG. 1.
Figure 3:
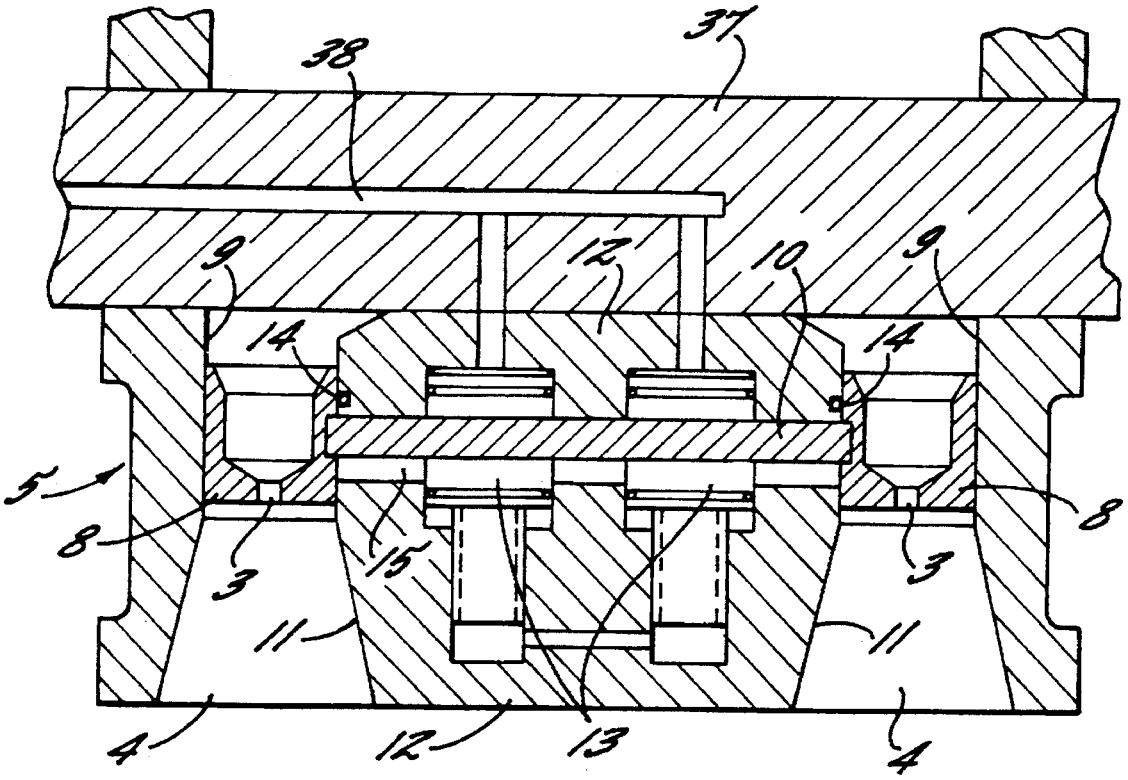
FIG. 3 is a schematic, enlarged sectional view of the interior of a shooting vessel in its illustration selected in FIGS. 1 and 2.
Figure 4:
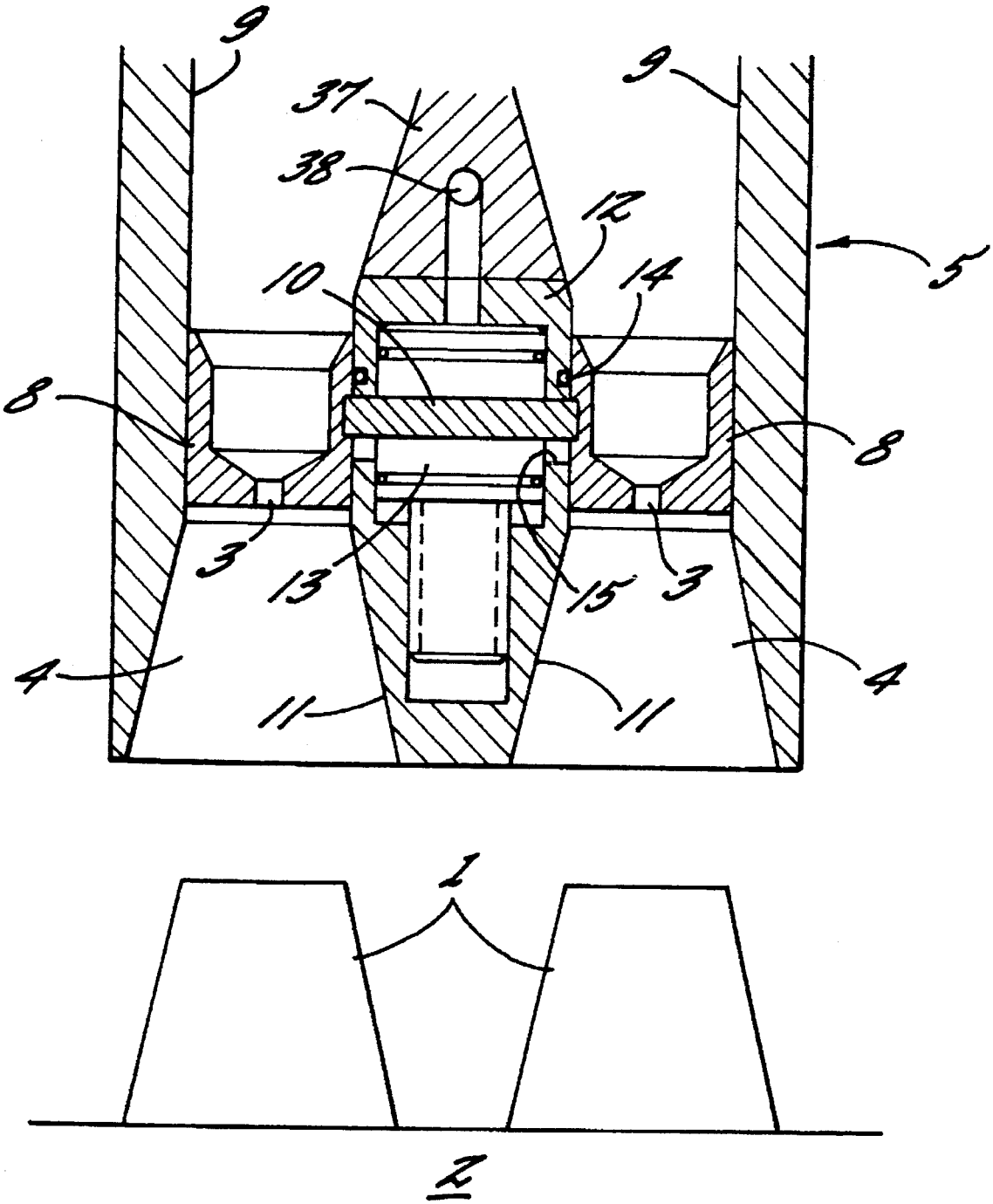
FIG. 4 illustrates the subject matter of FIG. 3 rotated by 90°, the pouring basin having already been ejected from the shooting mold.

As best shown in FIGS. 2, 3, and 4, the mechanism for shooting, consolidating and directly positioning the pouring basin is provided with a shooting vessel 5 which includes a peripheral wall 35 which defines an upper end and a lower end, and an upper chamber 36 defined within the peripheral wall and communicating with the upper end of the vessel. The lower portion of the chamber 36 mounts a shooting nozzle 3, and a mold 4 is position below the nozzle 3 so as to communicate with the lower end of the vessel 5. Further provided are a shooting and clamping head 6 as well as a counterholding mechanism 7. In accordance with the illustration of FIGS. 1 and 2, the shooting vessel 5 is clamped largely sealably between shooting and clamping head 6 and counterholding mechanism 7, the counterholding mechanism 7 forming the lower boundary of shooting mold 4.

As one can further note best from FIGS. 2, 3, and 4, the shooting nozzle 3 is formed in a working frame 8 serving as a shooting, pressing, and ejection frame. In the present embodiment, the shooting nozzle 3 is designed and constructed as a circumferential slot-type nozzle.

The working frame 8 accommodating shooting nozzle 3 is sealably arranged for sliding in axial direction along inside wall 9 of shooting vessel 5, namely, in the region of its end facing counterholding mechanism 7. The working frame 8 accommodating shooting nozzle 3 is operatively connected with an entrainment plate 10 extending in the center approximately crosswise to the direction of movement of working frame 8. The working frame 8 is axially displaceable by means of the entrainment plate for pressing and subsequently ejecting pouring basin 1, as well as for forcing pouring basin I onto sand mold 2, and it is sealably arranged for displacement between the inside wall 9 of shooting vessel 5 and outside wall 11 of an inside block 12 extending approximately in the center of shooting vessel 5.

As is further shown very clearly in FIGS. 2, 3, and 4, within inside block 12, two cylinders. 13 are formed which serve as pressing and ejecting cylinders and are biased hydraulically or pneumatically on both sides. The entrainment plate 10 extends through cylinder 13, and operates therein in the sense of a piston. A cross bar 37 is positioned in the shooting vessel 5 so as to immediately overlie the inside block 12, and the cross bar 37 includes a line 38 for delivering a pressurized hydraulic or pneumatic fluid to the two cylinders 13. The cross bar 37 is sized and configured so as to permit the sand to flow from the upper chamber 36 to the nozzle 3, and as illustrated in FIG. 4. The working frame 8 is dimensioned and arranged for displacement such that it or its,seals 14 directed toward outside wall 11 of inside block 12 always seal the passage 15 of entrainment plate 10 through inside block 12.

As indicated in FIG. 2, the shooting and clamping head 6 is provided with an air connection 16, which permits the sand to be transported from the shooting vessel 5 to the nozzle 3 by pressurized air in the head. An air filter 17 is provided for filtering air possibly flowing back after the shooting. As further shown in both FIGS. 1 and 2, the shooting and clamping head 6 is vertically movable via an upper clamping cylinder 18.

The counterholding mechanism 7, as shown in FIGS. 1 and 2, comprises a lower pressure plate 20 vertically movable by a lower clamping cylinder 19, so as to close shooting mold 4 in downward direction.

Within the scope of the illustrated embodiment, a second identical shooting vessel 5 is provided. Both shooting vessels 5 can be moved by means of a rotating mechanism 21 alternately from their shooting and pressing position between shooting and clamping head 6 and counterholding mechanism 7 to an ejecting position and, if need arises, refilling position between sand mold 2 and a sand bunker 22. The sand bunker 22 itself can be closed by means of an annular flap 23, so that its degree of opening allows to meter the sand, or to entirely close sand bunker 22. Only with reference thereto, should it be remarked that the shooting vessel 5 is equipped with a level probe 24, which indicates an adequate filling of shooting vessel 5 with molding sand, so that upon reaching the level preset by probe 24, the annular flap 23 of sand bunker 22 closes.

As shown in FIG. 1, the previously described rotating mechanism 21 comprises a swing arm 25 holding shooting vessel 5, which is jointed for vertical and rotational movement, approximately in the center between the shooting vessels 5, via a column 26 and a cylinder-piston arrangement 27, to a machine frame 28. The shooting and pressing position as well as the ejecting and refilling position of the shooting vessels 5 are diametrically opposed to one another. The rotating mechanism 21 is rotatable by 180°. Furthermore, the rotating mechanism 21 as a whole and, thus, the shooting vessels 5 can be adjusted in their horizontal position. To this end, swing arm 25 is jointed for rotational and pivotal movement, via a cylinder-piston arrangement 29, to shooting vessel 5, so that same can be vertically adjusted, in particular for depositing or pushing pouring basin 1.

An upper crossbeam 30 of machine frame 28 supports an automatic displacement shaft 31 of the cylinder-piston arrangement 27 or column 26. The machine frame 28 is constructed as a framework of the machine, and both sand bunker 22 and counterholding mechanism 7 are jointed to machine frame 28.

Figure 1A:
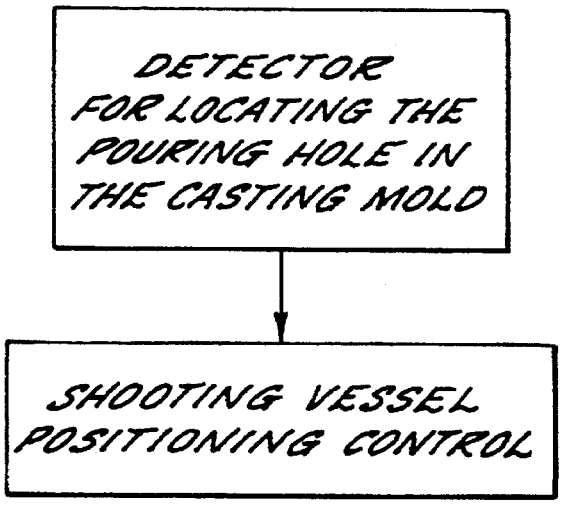
FIG. 1A is a schematic diagram illustrating the manner in which the positioning of the shooting vessel with respect to the sand mold is controlled.

As illustrated schematically in FIG. 1A, the apparatus preferably includes a detector for locating the exact position of the pouring hole in a sand mold 2 delivered to the apparatus, and the detector is linked to a shooting vessel positioning control for exactly positioning the shooting vessel 5 in alignment with the pouring hole by means of the above described support mechanisms for the shooting vessel.

With respect to the method of placing a pouring basin consisting of molding material or molding sand on a sand mold in accordance with the invention, reference is made to the corresponding description in the general part of this specification.

I claim:

1. An apparatus for molding a pouring basin (1) and placing the same directly upon a casting mold (2), said apparatus comprising a shooting vessel (5) including a peripheral wall (35) which defines an upper end and a lower end, and an upper chamber (36) defined within the peripheral wall and communicating with the upper end of the vessel, said shooting vessel further including a working frame (8) mounted for limited upward and downward movement in the lower portion of said chamber, at least one nozzle (3) formed in said working frame, means (10, 13) for selectively displacing the working frame in the upward and downward directions, and a shooting mold (4) positioned below said working frame and communicating with the lower end of said vessel, a shooting and clamping head (6) and a counterholding plate (20) disposed in a vertically spaced apart arrangement so as to define a shooting and pressing position therebetween, means mounting said shooting vessel to a support means for alternate movement between said shooting and pressing position and an ejecting position spaced therefrom and overlying a casting mold (2), whereby the shooting vessel is moved to said shooting and pressing position where a pouring basin (1) is molded in said shooting mold (4) and then consolidated by displacing the working frame downwardly so as to press the basin against the counterholding plate (20), and then the vessel and the molded and consolidated basin are moved to the ejecting position where the basin is ejected onto the casting mold (2) by downward movement of said working frame.

2. The apparatus as defined in claim 1 wherein said shooting mold (4) is of a closed, generally annular configuration.

3. The apparatus as defined in claim 2 wherein said shooting mold (4) has a cross sectional configuration which widens toward said lower end of said vessel.

4. The apparatus as defined in claim 1 wherein at least one of said shooting and clamping head (6) and said counterholding plate (20) is vertically movable so as to permit said vessel to be clamped therebetween when in said shooting and pressing position.

5. The apparatus as defined in claim 1 wherein said at least one nozzle comprises an opening extending vertically through said working frame.

6. The apparatus as defined in claim 1 wherein said at least one nozzle comprises a slit extending vertically through said working frame.

7. The apparatus as defined in claim 1 wherein said working frame includes means for sealing the same in said upper chamber during the upward and downward movement of the working frame.

8. The apparatus as defined in claim 1 wherein said shooting vessel further comprises an inside block (12) disposed in said upper chamber so as to define an annular portion of said upper chamber, and wherein said working frame (8) is of a corresponding annular configuration and is sealably mounted within said annular portion.

9. The apparatus as defined in claim 8 wherein said means for selectively displacing the working frame comprises an entrainment plate (10) which extends generally horizontally and is connected to said working frame, and at least one pressing cylinder mounted within said inside block and engaging said entrainment plate.

10. The apparatus as defined in claim 1 wherein said shooting and clamping head (6) includes an air connection (16) and a filter (17).

11. The apparatus as defined in claim 1 wherein the apparatus comprises a second shooting vessel (5) which is of the same construction as the first mentioned shooting vessel, and said mounting means acts to alternately rotate the two shooting vessels between the shooting and pressing position and the ejecting position.

12. The apparatus as defined in claim 11 wherein said mounting means comprises a rotatable member (21) mounted for rotation about a vertical axis, and a swing arm (25) mounted to the rotatable member (21) and connected to the two shooting vessels.

13. The apparatus as defined in claim 12 wherein said shooting and pressing position and said ejecting position are diametrically opposed to each other.

14. The apparatus as defined in claim 13 wherein said rotatable member (21), and thus said two shooting vessels are adjustable in the horizontal direction.

15. The apparatus as defined in claim 13 wherein said rotatable member (21), and thus said two shooting vessels, are adjustable in the vertical direction.

16. The apparatus as defined in claim 1 further comprising a sand bunker (22) mounted above said upper end of said shooting vessel when the shooting vessel is in said ejecting position, for delivering molding sand to said upper chamber.

17. A method of molding a pouring basin (1) and placing the same directly upon a casting mold (2) and comprising the steps of providing an apparatus which comprises (a) a shooting vessel (5) including a peripheral wall (35) which defines an upper end and a lower end, and an upper chamber (36) defined within the peripheral wall and communicating with the upper end of the vessel, said shooting vessel further including a working frame (8) mounted for limited upward and downward movement in the lower portion of said chamber, at least one nozzle (3) formed in said working frame, means (10,13) for selectively displacing the working frame in the upward and downward directions, and a shooting mold (4) positioned below said working frame and communicating with the lower end of said vessel, (b) a shooting and clamping head (6) and a counterholding plate (20) disposed in a vertically spaced apart arrangement so as to define a shooting and pressing position therebetween, and (c) means mounting said shooting vessel to a support means for alternate movement between said shooting and pressing position and an ejecting position spaced therefrom and overlying a casting mold (2), delivering a molding material into said upper chamber of said vessel, then moving the shooting vessel to said shooting and pressing position, then delivering the molding material from said upper chamber through said at least one nozzle and into said shooting mold so as to mold a pouring basin (1) therein, and then consolidating the molded pouring basin by displacing the working frame downwardly so as to press the basin against the counterholding plate (20), and then moving the vessel and the molded and consolidated basin to the ejecting position and then ejecting the basin onto the casting mold (2) by downward movement of said working frame.

18. The method according to claim 17 comprising the further steps of refilling the molding material into said upper chamber while the shooting vessel is in the ejecting position.

19. The method according to claim 18 wherein the shooting mold (4) and thus the molded pouring basin are of generally annular configuration, and wherein the casting mold (2) includes a pouring hole, and comprising the further steps of detecting the location of the pouring hole and adjustably positioning the shooting vessel at the ejecting position so that the pouring basin encircles the pouring hole of the casting mold.

20. The method according to claim 17 wherein the cycle time for the shooting head at each of the shooting and pressing position and the ejecting position is less than 10 seconds.

* * * * *